US011124958B1

(12) United States Patent
Gagliardi

(10) Patent No.: US 11,124,958 B1
(45) Date of Patent: Sep. 21, 2021

(54) DEBRIS CATCHING DEVICE FOR OPEN MANHOLE

(71) Applicant: Leanne M. Gagliardi, St. Albert (CA)

(72) Inventor: Leanne M. Gagliardi, St. Albert (CA)

( * ) Notice: Subject to any disclaimer, the term of this patent is extended or adjusted under 35 U.S.C. 154(b) by 39 days.

(21) Appl. No.: 15/723,916

(22) Filed: Oct. 3, 2017

Related U.S. Application Data

(60) Provisional application No. 62/403,439, filed on Oct. 3, 2016.

(51) Int. Cl.
*E02D 29/14* (2006.01)
*E03F 5/04* (2006.01)

(52) U.S. Cl.
CPC ..... *E03F 5/0403* (2013.01); *E02D 29/14* (2013.01); *E02D 2200/1607* (2013.01); *E02D 2200/1628* (2013.01)

(58) Field of Classification Search
CPC ..... E03F 5/0403; E03F 5/0404; B01D 29/05
USPC ..... 210/163, 164; 404/25
See application file for complete search history.

(56) References Cited

U.S. PATENT DOCUMENTS 4,418,432 A * 12/1983 Vidal ..... A47K 1/14 210/163
4,419,232 A * 12/1983 Arntyr ..... E03C 1/262 210/164
5,052,851 A * 10/1991 Frishauf ..... E02D 29/124 404/25
5,372,714 A * 12/1994 Logue, Jr. ..... E03F 5/0404 210/163
5,480,254 A * 1/1996 Autry ..... E03F 5/0401 210/163
5,529,431 A * 6/1996 Walsh ..... E02D 29/124 210/164
5,951,200 A 9/1999 Barton
5,956,905 A * 9/1999 Wiedrich ..... E02D 29/121 220/220
6,083,402 A * 7/2000 Butler ..... E03F 1/00 210/170.03
6,086,758 A * 7/2000 Schilling ..... B01D 29/23 210/164
6,149,803 A * 11/2000 DiLoreto, Jr. ..... B01D 29/03 210/164
6,261,445 B1 * 7/2001 Singleton ..... B01D 29/15 210/163
6,274,036 B1 * 8/2001 Ellis ..... B01D 29/27 210/164
6,401,759 B1 6/2002 Kamiyama et al.
6,537,446 B1 * 3/2003 Sanguinetti ..... E03F 1/00 210/163

(Continued)

FOREIGN PATENT DOCUMENTS

WO WO-2010120183 A1 * 10/2010 ..... E02D 29/14

*Primary Examiner* — Thomas B Will
*Assistant Examiner* — Katherine J Chu
(74) *Attorney, Agent, or Firm* — Cramer Patent & Design PLLC; Aaron R. Cramer

(57) ABSTRACT

A debris catching device suitable for an open manhole includes a basket having a diameter slightly less than that of the manhole aperture and a durable flange secured to the periphery of the basket opening. The flange has a plurality of lifting hooks secured to a top face opposite the bottom of the basket. The interior of the rubber flange is reinforced with a ring running throughout the middle circumference thereof.

2 Claims, 6 Drawing Sheets

(56) References Cited

U.S. PATENT DOCUMENTS 6,537,447 B2 * 3/2003 Remon ..... B01D 29/03 210/163
6,551,023 B2 * 4/2003 Allard ..... B01D 29/27 210/163
6,872,029 B2 * 3/2005 Allard ..... B01D 29/27 405/36
6,922,953 B1 * 8/2005 Lewis ..... E03F 1/00 211/175
6,953,302 B1 * 10/2005 Kochling ..... E02D 29/121 404/26
6,976,808 B2 * 12/2005 Allard ..... B01D 35/30 405/36
7,070,691 B2 * 7/2006 Lindemulder ..... E03F 1/00 210/164
7,112,274 B1 * 9/2006 Sanguinetti ..... B01D 29/01 210/163
7,153,057 B1 12/2006 Lucas
7,186,333 B2 * 3/2007 Kluge ..... E03F 1/00 210/164
7,201,843 B2 * 4/2007 Sasaki ..... B01D 29/27 210/164
7,303,354 B1 * 12/2007 DeCroix ..... E02D 29/14 404/25
7,524,414 B1 * 4/2009 Barragan ..... E03F 1/00 210/163
7,549,820 B1 * 6/2009 Happel ..... E03F 1/00 210/163
7,670,483 B2 * 3/2010 Ringenbach ..... E03F 1/00 210/163
7,748,927 B2 7/2010 Neathery
7,837,869 B2 * 11/2010 Peters, Jr. ..... B01D 39/083 210/164
7,883,290 B1 2/2011 Ross et al.
8,475,655 B2 * 7/2013 Sasaki ..... E03F 5/0404 210/162
8,652,323 B2 * 2/2014 Dorsey ..... E03F 1/00 210/164
9,051,192 B2 * 6/2015 Kent ..... E03F 5/0404
9,624,658 B2 * 4/2017 Hannah ..... E03F 5/0404
10,167,620 B2 * 1/2019 Zock ..... E03F 5/0404
10,208,449 B2 * 2/2019 Ruckel ..... E02D 29/1409
10,422,119 B2 * 9/2019 Coppola ..... E03F 5/0404
10,508,430 B2 * 12/2019 Riley ..... B01D 15/00
2002/0113025 A1 * 8/2002 Gauldin ..... E03F 5/0404 210/767
2004/0031735 A1 2/2004 Fobbe
2005/0247612 A1 * 11/2005 Glassheim ..... E03F 1/00 210/163
2006/0251476 A1 * 11/2006 Suddeth ..... E02D 29/14 405/25
2008/0251470 A1 * 10/2008 Kent ..... E03F 1/00 210/791
2009/0101553 A1 * 4/2009 Lucas ..... E03F 1/00 210/164
2013/0118963 A1 * 5/2013 Bailey ..... E03F 5/0404 210/164
2013/0129418 A1 5/2013 Wander
2013/0186811 A1 * 7/2013 Kaiser ..... E03F 5/0404 210/163
2013/0299402 A1 * 11/2013 Rogahn ..... E03F 5/0404 210/163
2018/0023282 A1 * 1/2018 Coppola ..... E03F 5/16 210/163

* cited by examiner

DEBRIS CATCHING DEVICE FOR OPEN MANHOLE

RELATED APPLICATIONS

The present invention is a continuation-in-part of, was first described in and claims the benefit of U.S. Provisional Application No. 62/403,439 filed Oct. 3, 2016, the entire disclosures of which are incorporated herein by reference.

FIELD OF THE INVENTION

The present invention relates generally to a debris catching device suitable for placement within an open manhole.

BACKGROUND OF THE INVENTION

The site of manhole covers and paved surfaces such as roadways and parking lots is a common one (1). Such manhole covers provide access to underground utilities such as water, sewer, electrical power, communication lines, and the like. They provide ready access to such utilities but in a manner which is minimally disruptive to overall visual appearances. The frames of such manhole covers are set flush with the paving surface such that passage of vehicles, people, and the like can occur.

However, when this flush location means dirt, gravel and other foreign material can also easily enter during construction and renovation projects. This means that much time, effort, and cost must be spent later removing such material by hand or with a hydro-vac machine. Accordingly, there exists a need for a means by which an open manhole can be protected from the entrance of unwanted foreign material in an effort to address the problem described above. The use of the present invention provides the ability to protect manhole interiors during construction and renovation projects in a manner which is quick, easy, and effective.

SUMMARY OF THE INVENTION

The inventor has recognized the aforementioned inherent problems and lack in the art and observed that there is a need for a debris catching device suitable for placement within an open manhole.

It is therefore an object of the invention to provide a debris catching device, comprising a support base having a support base top, a support base bottom, a support base exterior side and a support base interior side, a catcher liner defining a liner interior which is secured within the support base interior side and extending beneath the support base bottom and a plurality of lifting fixtures disposed upon the support base top. The support base is configured to mount over an open top of a manhole. The catcher liner is configured to suspend within the manhole. The catcher liner is capable of retaining debris therein. In an alternate embodiment, the catcher lining is removeable secured within the support base interior side by a plurality of fasteners.

The support base may also comprise an interior cavity having a filling port in environmental communication with the interior cavity. The support base is circular, square, or rectangular. The support base may be made of a rigid, flexible material and may have a durable coating. The device may also have at least one (1) elevation base. Each elevation base may comprise a shape identical to the support base. Each elevation base is configured to rest upon either the support base or another elevation base.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
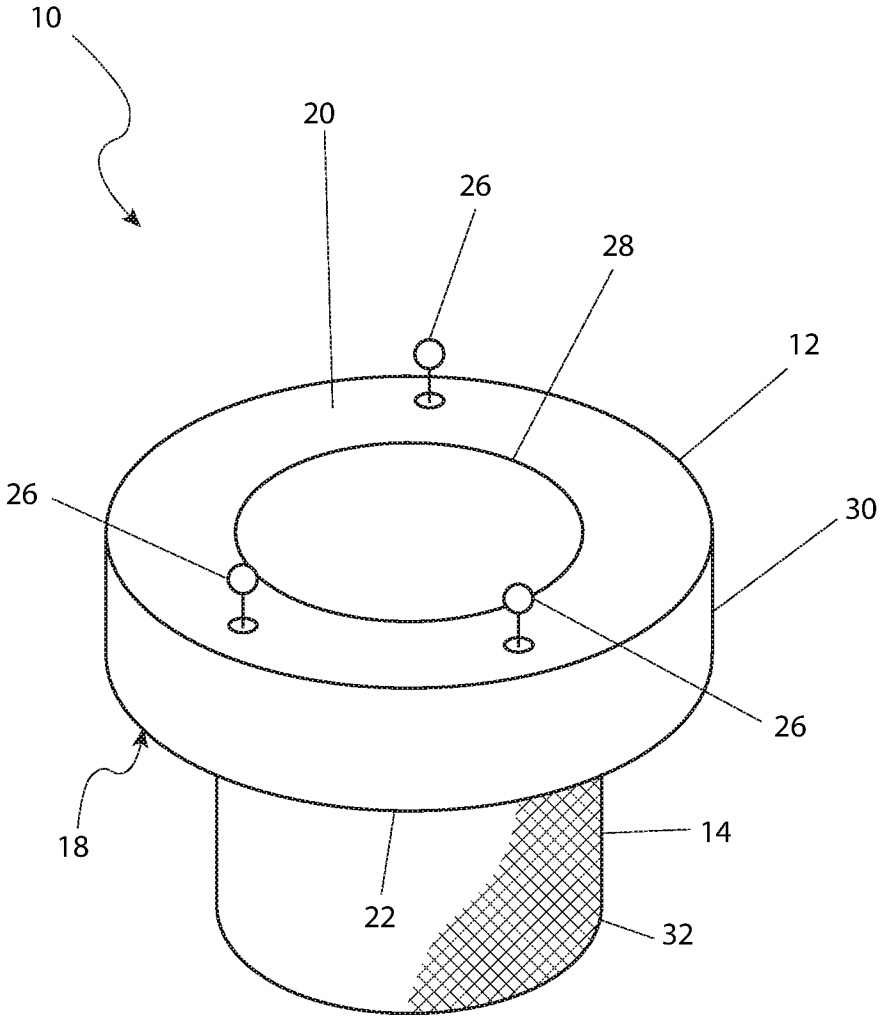
FIG. 1 is a top and side perspective view of an embodiment of the disclosed covering and debris catching device for a manhole.

10 covering and debris catching device
12 support base
14 catcher liner
16 elevation base
18 support base-body
20 top
22 bottom
24 barrier
26 lifting fixture
28 inner side
30 outer side
32 catcher liner-body
34 interior chamber
36 weighting material
38 filling port
40 fastener
42 catch
44 opening
46 receptacle
48 seal
100 manhole
102 debris
104 manhole opening
106 manhole structure
108 grade surface
110 adjustable grade ring

DETAILED DESCRIPTION OF THE PREFERRED EMBODIMENT

Referring to FIGS. 1-6, disclosing a covering and debris catching device for an open manhole, herein generally referred to as a device 10, where like reference numerals represent similar or like parts. The disclosed device 10 provides temporary protection for a manhole opening 104 of a manhole 100 against debris 102 and other foreign material, such as gravel and dirt created, disturbed and/or moved during a construction project, from entering the open manhole 100. The protective nature of the disclosed device 10 eliminates or greatly reduces the amount of cleanup activity required, such as "hydro-vacing," the interior of the manhole 100, following periods of time when a manhole cover (not shown) is removed from the manhole 100.

FIG. 1 is a schematic illustration of a top and side perspective view of an exemplary embodiment of the disclosed device 10. The device 10 includes a support base 12 and a catcher liner 14 connected to the support base 12. The support base 12 includes a support base-body 18. In the embodiment illustrated in FIG. 1, the support base-body 18 has an approximately ring-shape when viewed from a top 20 and a bottom 22. As an example, the support base-body 18 may have an approximately circular shape when viewed from the top 20 and the bottom 22. As another example, the support base-body 18 may have an approximately square shape when viewed from the top 20 and the bottom 22. As yet another example, the support base-body 18 may have an approximately rectangular shape when viewed from the top 20 and the bottom 22. The catcher liner 14 is connected to the support base-body 18 and extends (e.g., downwardly) from the bottom 22 of the support base-body 18.

Figure 2:
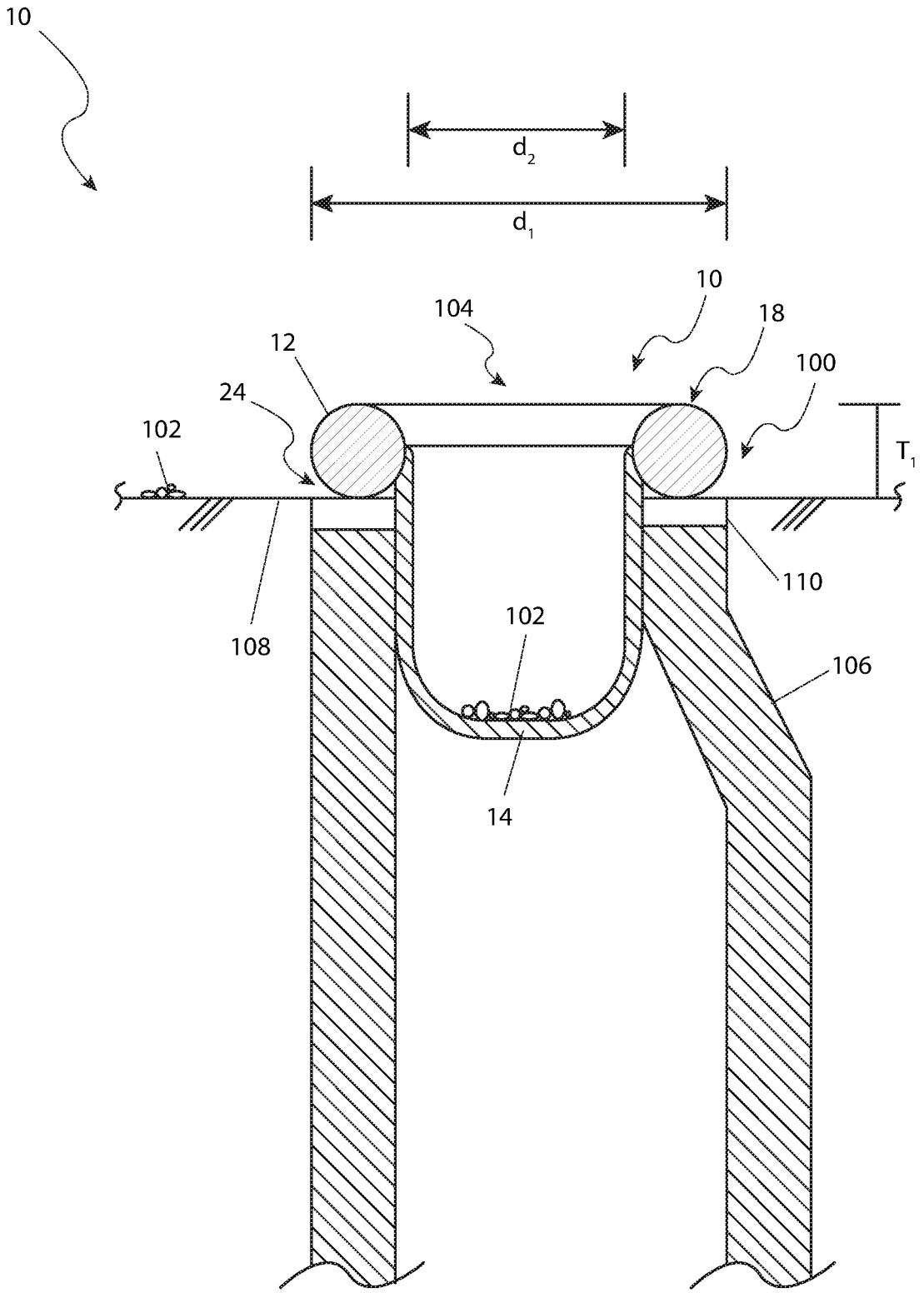
FIG. 2 is a side elevation view, in section, of an example of the disclosed covering and debris catching device mounted to an example manhole.
Figure 5:
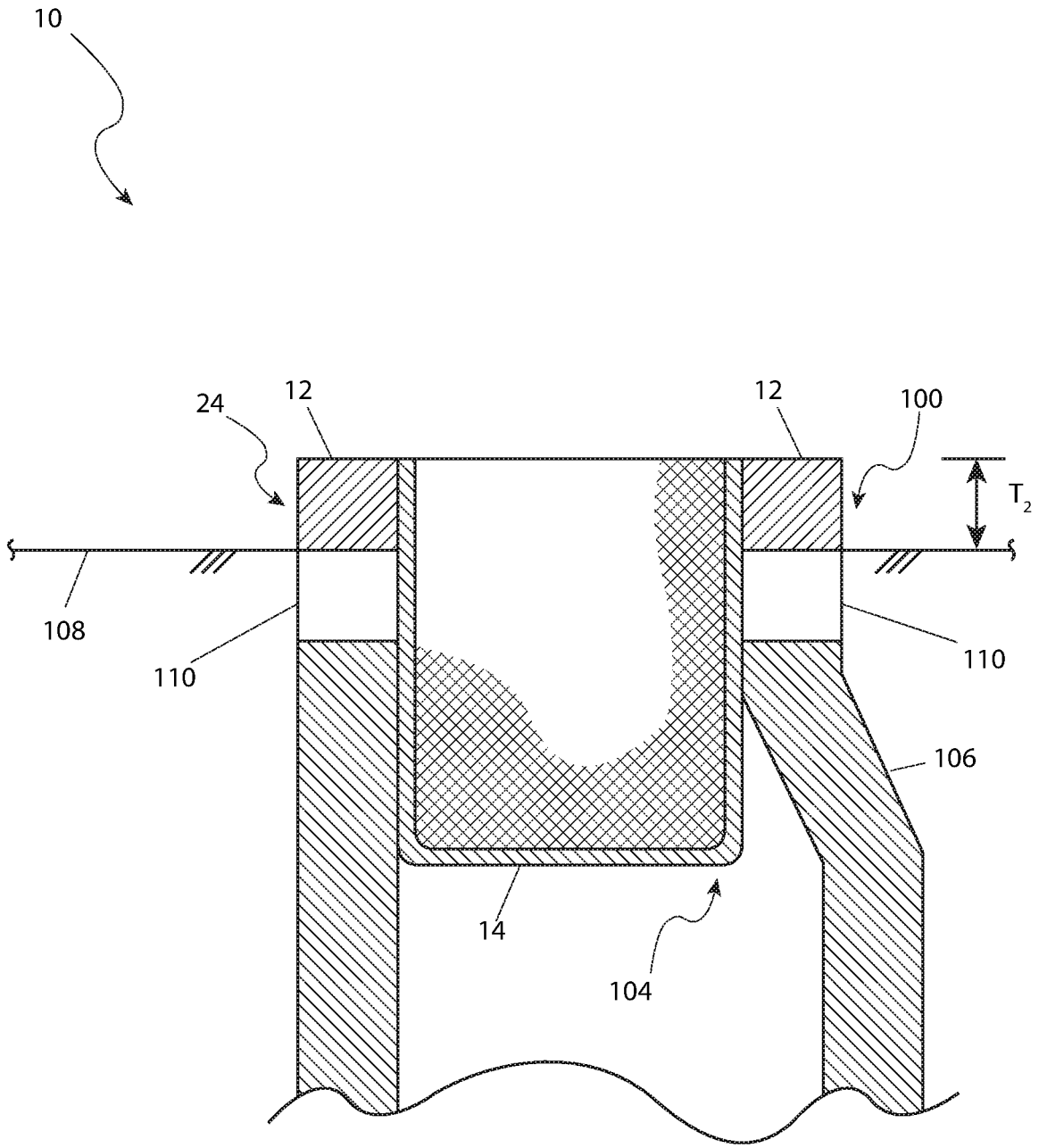
FIG. 5 is a side elevation view, in section, of another example of the disclosed covering and debris catching device mounted to an example manhole; and, FIG. 6 is a side elevation view, in section, of another example of the disclosed covering and debris catching device mounted to an example manhole.
Figure 6:
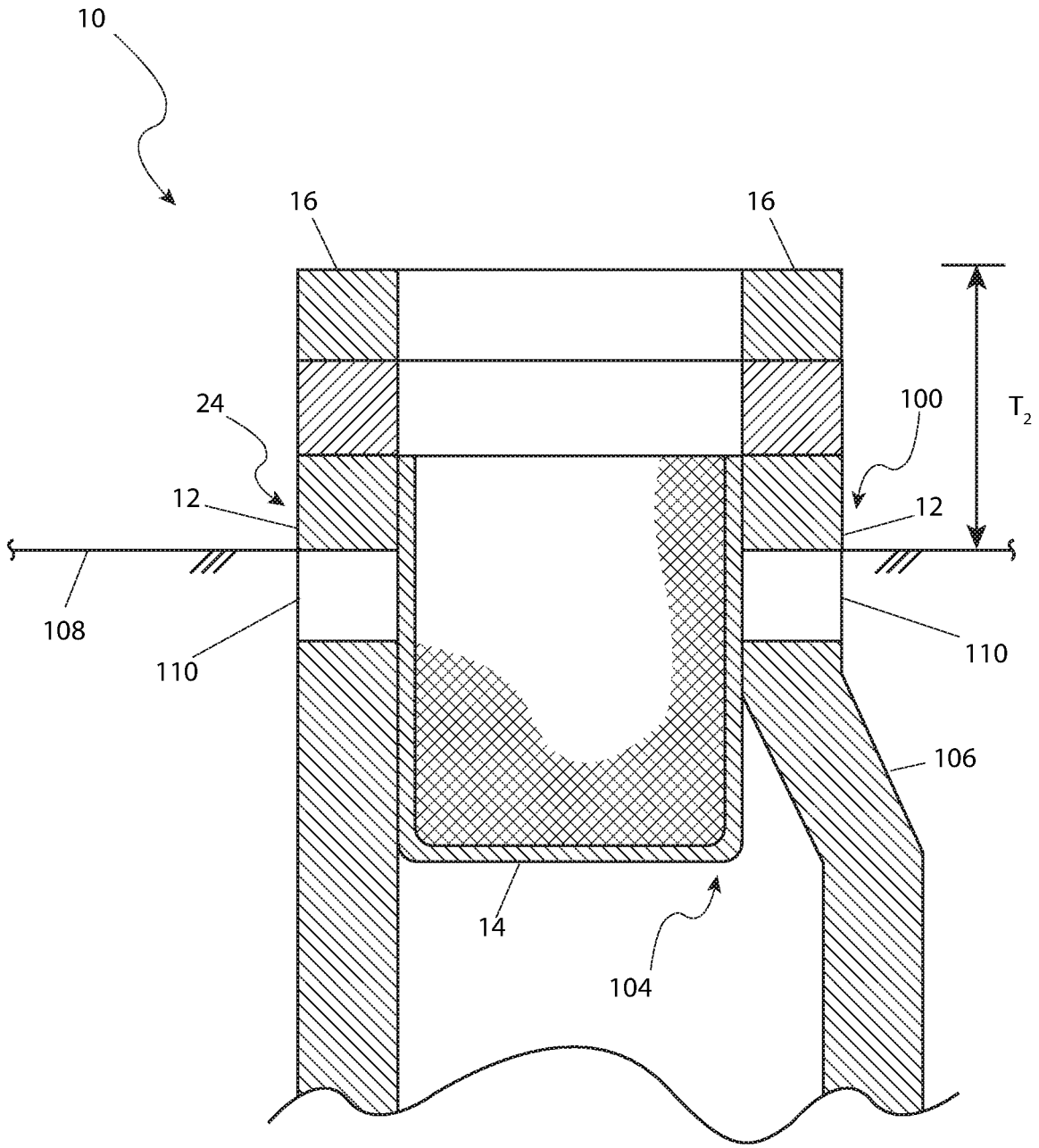

FIG. 2 is a schematic illustration of a side elevation view, in section, of the disclosed device 10 mounted to an example manhole 100. The manhole 100 may have various sizes, shapes and configurations depending upon construction and purpose. Thus, the example manhole 100 illustrated in FIGS. 2, 5 and 6 is merely one (1) example of a manhole into which the disclosed device 10 may be mounted. Generally, the manhole 100 includes a generally tubular manhole structure 106 forming the main body of the manhole 100 having a manhole opening 104 at or near the grade surface 108. As an example, the manhole structure 106 may include a cylindrical body. As another example, the manhole structure 106 may include a cylindrical body portion and a conical body portion, for example, at or near the grade surface 108. The manhole 100 may also include one (1) or more adjustable grade rings 110. The adjustable grade rings 110 are mounted to the upper, exposed end of the manhole structure 106, for example, level with the grade surface 108, and form the manhole opening 104.

The support base 12 is configured for mounting over top of the manhole opening 104 of the manhole 100 and for supporting the catcher liner 14. The catcher liner 14 is configured to be inserted through the manhole opening 104 and be suspended within the manhole structure 106.

In an example implementation, the device 10 is portable and temporary in nature, for example, for use during the extent of a construction project, and then removed and/or moved to another location as needed. As an example, the support base 12 is used to maintain a temporary position of the catcher liner 14 within the manhole 100, while the support base-body 18 is supported by the adjustable grade ring 110 and/or the grade surface 108.

In the illustrated example, the support base 12 is suitably sized to surround the manhole opening 104. The support base-body 18 includes a suitable thickness $T_1$ such that the support base 12 forms or defines a barrier 24 around a perimeter of the manhole opening 104 to prevent debris 102 from a grade surface 108 from entering the manhole opening 104. As an example, the thickness $T_1$ of the barrier 24 formed by the support base 12 is between approximately one inch (1 in.; approximately 25 mm) and approximately six inches (6 in.; approximately 150 mm). In the exemplary embodiment, the thickness $T_1$ is no more than six inches (6 in.).

The catcher liner 14 is suitably sized to closely fit within the manhole structure 106 when suspended from the support base 12 through the manhole opening 104 to catch any debris 102 that may fall through the manhole opening 104 and prevent such debris 102 from entering and falling into the manhole structure 106.

Figure 3:
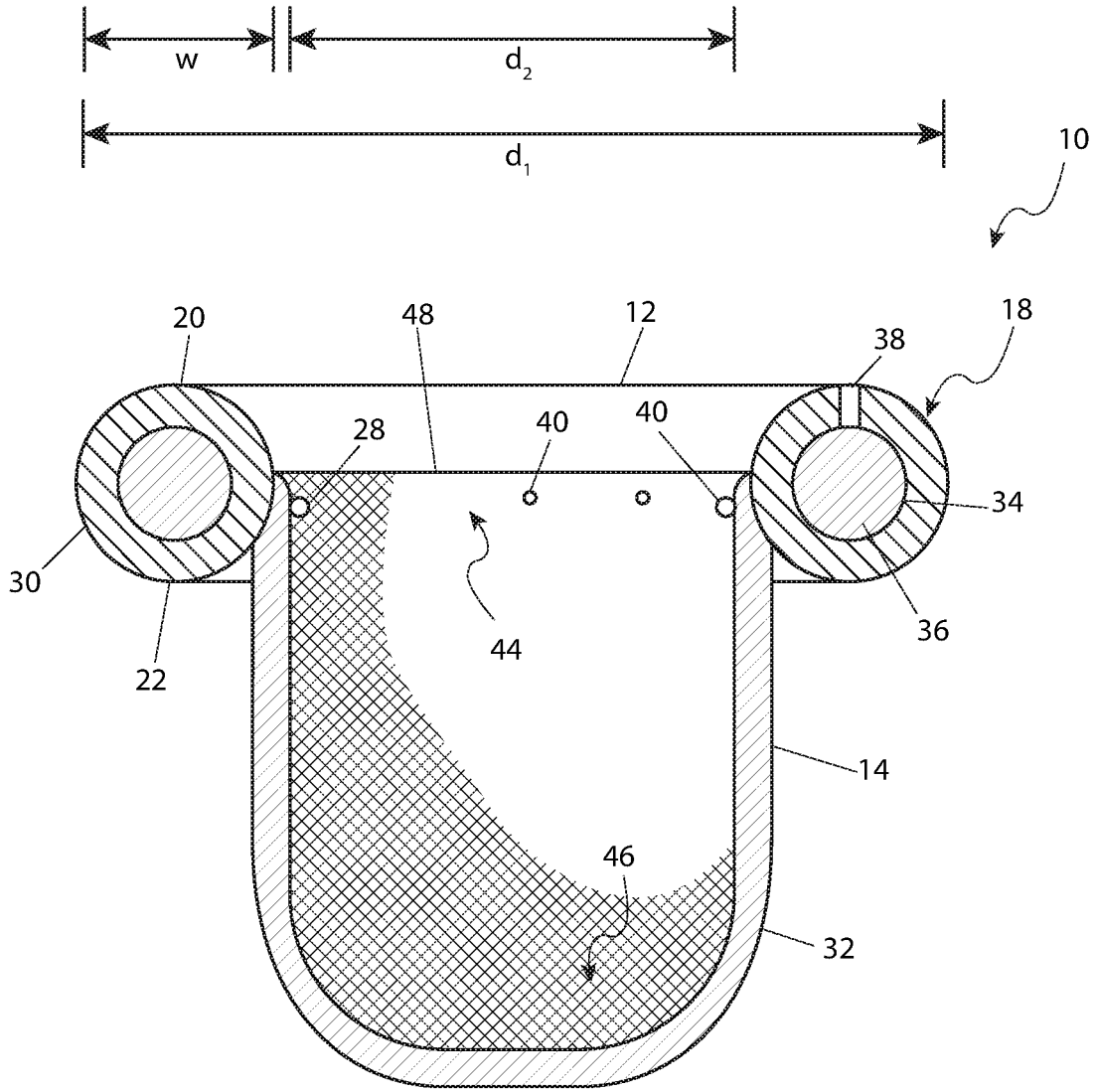
FIG. 3 is a side elevation view, in section, of another embodiment of the disclosed covering and debris catching device for a manhole.
Figure 4:
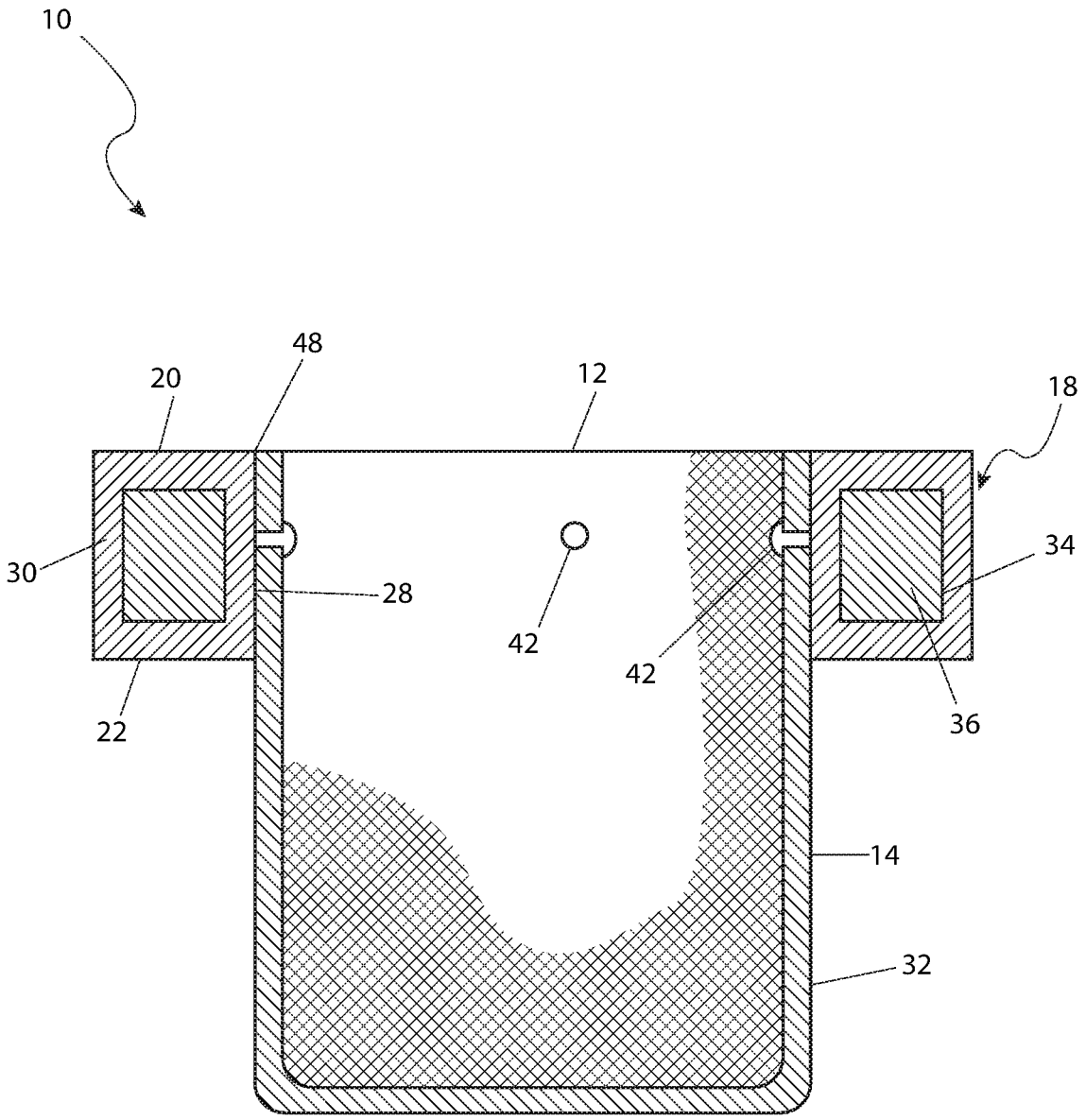
FIG. 4 is a side elevation view, in section, of another embodiment of the disclosed covering and debris catching device for a manhole.

FIG. 3 is a schematic illustration of a side elevation view, in section, of another example embodiment of the disclosed device 10. FIG. 4 is a schematic illustration of a side elevation view, in section, of another example embodiment of the disclosed device 10. In the embodiment illustrated in FIG. 3, the support base 12 has an approximately circular shape in cross section. In other embodiments, the support base 12 may have other shapes in cross section. As an example, in the embodiment illustrated in FIG. 4, the support base 12 has an approximately square or rectangular shape in cross section. In the various embodiments disclosed herein, and regardless of the cross-sectional shape of the support base 12, the support base-body 18 includes the top 20, the bottom 22, an inner side 28 and an outer side 30. In the exemplary embodiment, the bottom 22 of the support base-body 18 is substantially flat in order to make substantially flush contact with an outer surface of the adjustable grade ring 110 of the manhole 100 and/or the grade surface 108.

The support base 12 has a suitable weight to limit movement of the support base 12 relative to the manhole 100. As an example, the support base-body 18 is weighted. As another example, and as illustrated in FIGS. 3 and 4, the support base-body 18 includes a hollow interior chamber 34 formed (e.g., defined) by the top 20 (e.g., a top wall), the bottom 22 (e.g., a bottom wall), the inner side 28 (e.g., an inner side wall) and the outer side 30 (e.g., an outer side wall). The interior chamber 34 is configured to be filled with a weighting material 36.

In an example embodiment, the support base-body 18 may be made of a rigid and durable material. As an example, the support base-body 18 (e.g., the top 20, the bottom 22, the inner side 28 and the outer side 30) is made of plastic, such as acrylonitrile butadiene styrene (ABS) plastic. In this example, the support base-body 18 with the hollow interior chamber 34 may be made by a plastic injection molding process or blow molding process. In this example embodiment, the weighting material 36 may be any material having a relative large mass per volume that is capable of filling the interior chamber 34, for example, through a sealable filling port 38 (FIG. 3). As non-limiting examples, the weighting material 36 may include granular or liquid materials, such as sand, dirt, gravel, water and the like or combinations thereof. In this example embodiment, the weighting material 36 may be removed (e.g., emptied) from the support base-body 18 in order to ease transportation and storage of the device 10.

In another example embodiment, the support base-body 18 may be made of a durable flexible material. As an example, the support base-body 18 is made of rubber. In this example, the support base-body 18 with the hollow interior chamber 34 may be made by a liquid rubber injection molding process. In this example embodiment, the weighting material 36 may be any material having a relative large mass per volume that is capable of filling the interior chamber 34, for example, through a sealable filling port 38. In this example embodiment, the weighting material 36 may be removed (e.g., emptied) from the support base-body 18 in order to ease transportation and storage of the device 10. Further, in this example embodiment, when the weighting material 36 is removed from the support base-body 18, the support base-body 18 may collapse in order to reduce the space needed for storage of the device.

In another example embodiment, the support base-body 18 may be made of a durable coating material. As an example, the support base-body 18 is made of rubber. In this example, the weighting material 36 may be a solid material, such as a concrete or metal ring. In this example, the support base-body 18 may be formed over and around the solid weighting material 36 by a dip molding or dip coating process.

In another specific, non-limiting example embodiment, the support base-body 18 is a recycled tire. In this example embodiment, an interior of the recycled tire (e.g., the support base-body 18) is filled with sand, dirt, gravel or concrete (e.g., the weighting material 36) in order to increase the weight of the support base 12. This example embodiment may provide an environmentally friendly option by recycling and reusing materials that would otherwise become solid waste.

The catcher liner 14 is connected to the support base-body 18 and extends from the bottom 22 of the support base-body 18. In an example, the catcher liner 14 is connected to the bottom 22 of the support base-body 18. In another example, the catcher liner 14 is connected to the top 20 of the support base-body 18. In another example, and as illustrated in FIGS. 3 and 4, the catcher liner 14 is connected to the inner side 28 of the support base-body 18. In yet another example, the catcher liner 14 is connected to the outer side 30 of the support base-body 18.

In the example embodiment illustrated in FIG. 3, the catcher liner 14 is affixed (e.g., permanently connected) to the support base-body 18 by one (1) or more fasteners 40. As an example, the catcher liner 14 may be affixed to the support base-body 18 by a plurality of mechanical fasteners, such as screws, rivets, bolts and the like. As another example, the catcher liner 14 may be affixed to the support base-body 18 by an adhesive fastener, such as glue, cement and the like. As another example, the catcher liner 14 may be affixed to the support base-body 18 by stitch fasteners, such as stitching. As yet another example, the catcher liner 14 may be affixed to the support base-body 18 by a combination of a plurality of mechanical fasteners, an adhesive fastener and/or stitch fasteners.

In the example embodiment illustrated in FIG. 4, the catcher liner 14 is attached (e.g., removably connected) to the support base-body 18 by one (1) or more catches 42. As an example, the catcher liner 14 may be attached to the support base-body 18 by a plurality of mechanical catches, such as snaps (e.g., a snap cap or snap stud), buttons, buckles, latches, hooks and the like. In such an embodiment, the catcher liner 14 also includes corresponding and cooperating catch features, such as snaps (e.g., the snap cap or the snap stud), holes for receiving buttons, eyelets for receiving hooks or latches and the like.

The catcher liner 14 includes a catcher liner-body 32. The catcher liner-body 32 includes an opening 44 formed (or defined) by the inner side 28 of the support base-body 18 and a receptacle 46 configured to catch debris 102.

In an example embodiment, the catcher liner-body 32 is flexible and hangs from the support base-body 18. For example, the flexible catcher liner body 32 may take the form of a bag that can easily be emptied or removed and disposed of. As an example of this embodiment, the catcher liner-body 32 may be made of a textile material. In an example, the catcher liner-body 32 may be water-permeable, such as in the form of a relative fine-mesh fabric sheet consisting of a network of natural or artificial fibers, such as nylon fabric, polyester fabric and the like. In another example, the catch liner-body 32 may be waterproof, such as in the form of a sheet of plastic, such as polyethylene or polypropylene, or a polyester canvas coated with urethane.

As an example of this embodiment, the flexible catcher liner-body 32 may have or take the form of an approximately cylindrical shape or "U"-shape when inserted through the manhole opening 104 and suspended within the manhole structure 106 (FIG. 2). In this embodiment, at least a portion of or all of the catcher liner-body 32 may be in contact with the inner walls forming the manhole structure 106, for example, at or near the manhole opening 104. As another example of this embodiment, the catcher liner-body 32 may have or form an approximately conical shape when inserted through the manhole opening 104 and suspended within the manhole structure 106.

In another example embodiment, the catcher liner-body 32 is rigid and extends from the support base-body 18. As an example of this embodiment, the catcher liner-body 32 may be made of plastic, such as ABS plastic. In an example, the catcher liner-body 32 may be water-permeable by having a plurality of relatively small holes formed therethrough.

As an example of this embodiment, the rigid catcher liner-body 32 may have an approximately cylinder shape configured to be inserted through the manhole opening 104 and fit within the manhole structure 106 (FIG. 2). In this embodiment, at least a portion of or all of the catcher liner-body 32 may be in contact with the inner walls forming the manhole structure 104.

In an embodiment of the disclosed device 10, the catcher liner 14 is sealed to the support base 12. As an example, a seal 48 is formed between the catcher liner-body 32 and the support base-body 18. The seal 48 is configured to prevent small debris 102 from falling between the support base 12 and the catcher liner 14 and into the manhole structure 106 (FIG. 2).

Referring now to FIG. 3, the support base-body 18 includes an outside dimension (e.g., diameter) $D_1$ defined between opposing points on the outer side 30 and an inside dimension (e.g., diameter) $D_2$ defined between opposing points on the inner side 28. The outside dimension $D_1$ may be approximately equal to or substantially match the outer diameter of the manhole structure 106 or the adjustable grade ring 110. The outside dimension $D_1$ may vary depending upon various factors such as the size of the manhole opening 100, the size of the adjustable grade ring 110, the type of grade surface 108 and the like. The inside dimension $D_2$ may be approximately equal to or substantially match the inner diameter of the manhole opening 104. The inside dimension $D_2$ may vary depending upon various factors such as the size of the manhole opening 100, the size of the adjustable grade ring 110 and the like.

The support base-body 18 also include a width W defined between opposing points on the outer side 30 and the inner side 28 (e.g., the outside dimension $D_1$ minus the inside dimension $D_2$). The width W may be approximately equal to or substantially match the width of the adjustable grade ring 110.

Referring to FIGS. 3 and 4, in an example embodiment, the outside dimension $D_1$ (FIG. 4) of the support base-body 18 is approximately equal to an outside dimension (e.g., diameter) $d_1$ (FIG. 2) of the manhole structure 106. In this example, the bottom 22 (FIG. 4) of the support base-body 18 rests on and is supported by an end of the manhole structure 106 defining the manhole opening 104 at the grade surface 108, for example, the adjustable grade ring 110. In another example embodiment, the outside dimension $D_1$ of the support base-body 18 is greater than the outside dimension d1 of the manhole structure 106. In this example, the bottom 22 (FIG. 4) of the support base-body 18 rests on and is partially supported by both an end of the manhole structure 106 (e.g., the adjustable grade ring 110) and the grade surface 108 or rests on and is entirely supported by the grade surface 108.

In an example embodiment, the inside dimension $D_2$ (FIG. 4) of the support base-body 18 is approximately equal to an inside dimension (e.g., diameter) $d_2$ (FIG. 2) of the manhole structure 106 defining the manhole opening 104. In another example embodiment, the inside dimension $D_2$ (FIG. 4) of the support base-body 18 is greater than the inside dimension (e.g., diameter) $d_2$ (FIG. 3) of the manhole structure 106 defining the manhole opening 104. As yet another example embodiment, the inside dimension $D_2$ (FIG. 4) of the support base-body 18 is less than the inside dimension (e.g., diameter) $d_2$ (FIG. 3) of the manhole structure 106 defining the manhole opening 104.

Referring to FIG. 1, in an example embodiment, the support base 12 also includes a plurality of lifting fixtures 26. The lifting fixtures 26 are configured to allow the device 10 to be placed over and removed from the manhole 100, for example, with the aid of a crane, backhoe, or similar piece of equipment. As an example, the plurality of lifting fixtures 26 are affixed to the top 20 of the support base-body 18. As examples, the lifting fixtures 26 may be hooks, eye bolts or the like fastened or otherwise connected to the support base-body 18.

FIG. 5 is a schematic illustration of a side elevation view, in section, of another example of the disclosed device 10 mounted to the manhole 100. FIG. 5 illustrates the support base-body 18 having the generally square or rectangular cross-sectional shape, such as in the embodiment illustrated in FIG. 4.

FIG. 6 is a schematic illustration of a side elevation view, in section, of another example of the disclosed device 10 mounted to the manhole 100. In another embodiment, the device 10 includes one (1) or more elevation bases 16. The elevation base 16 is configured to raise the overall height of device 10 and thus increase the thickness of the barrier 24.

In the illustrated example, the elevation base 16 is suitably sized to surround the manhole opening 104. As an example, and as illustrated in FIG. 6, a plurality of the elevation bases 16 (e.g., two (2) elevation bases 16 are shown by example) may be supported by and stacked on top of the support base 12 such that the combination of the support base 12 and the one (1) or more elevation bases 16 is configured to increase the overall combined thickness $T_2$ of the barrier 24, such that the support base 12 and the elevation base 16 form or define a larger barrier 24 around a perimeter of the manhole opening 104 to prevent debris 102 from a grade surface 108 from entering the manhole opening 104.

In the embodiment illustrated in FIG. 6, the elevation base 16 has an approximately ring-shape when viewed from a top and a bottom. The elevation base 16 has a size and shape substantially matching the size and shape of the support base 12. As examples, the elevation base 16 may have an approximately circular shape or an approximately square or rectangular shape when viewed from the top and the bottom 22. As other examples, the elevation base 16 may have an approximately circular shape in cross-section, an approximately square or rectangular shape in cross-section or other shapes in cross-section. Regardless of the shape in plan view or the cross-sectional shape of the elevation base 16, in the exemplary embodiment, the bottom of the elevation base 16 is substantially flat in order to make substantially flush contact with the top 20 of the support base 12.

While not explicitly illustrated, in various example embodiments, the elevation base 16 includes substantially the same materials, features and construction as the support base 12 described herein.

Accordingly, use of the disclosed device 10 provides the ability to protect the interior of the manhole 100 during periods when the manhole cover is removed, for example, during construction and renovation projects, in a manner which is quick, easy, and effective. When the construction project is finished and the final adjustable grade ring for the manhole 100 is ready to be placed, the device 10 is simply moved away. The device 10 can be reused over and over with periodic replacement of the catcher liner 14 as necessary.

The materials required to produce the disclosed device 10 are all readily available and well known to manufacturers of goods of this type. The hollow support base-body 18, to be filled with the weighting material 36, or the weighting material 36 filled support-base body 18 may be made according to suitable casting, molding or other manufacturing processes. If needed, suitable jigs and other assembly aids may be utilized for production and to ensure consistency. The catching liner 14 may be cut to size, for example, according to a pattern and connected to the support base-body 18. The raw materials as used in manufacture of the disclosed device 10 may best be obtained from wholesalers and manufacturers that deal in goods of that nature and assembled at a final location.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A debris catching device, consisting of:

a circular support base to accommodate a circular manhole opening that includes:
- a circular support base top;
- a circular support base bottom;
- a circular support base exterior side; and
- a circular support base interior side;

a circular catcher liner defining a liner interior secured within said circular support base interior side and extending beneath said circular support base bottom; and a plurality of lifting fixtures disposed upon said support base top, said lifting fixtures are a plurality of hooks or a plurality of eye bolts, said lifting fixtures allow said debris catching device to be placed over and removed from a circular manhole;

wherein said circular support base is mounted over an open top of said circular manhole;

wherein said circular catcher liner is suspended within said circular manhole;

wherein said circular catcher liner is retaining debris therein;

wherein said circular support base includes a circular interior cavity;

wherein said circular support base includes a filling port in environmental communication with said interior cavity;

wherein said circular support base is made of a rigid materials;

wherein said support base is made of a acrylonitrile butadiene styrene plastic; and wherein said circular catcher liner is made of a fine-mesh nylon fabric sheet.

2. A debris catching device, consisting of:

a circular support base that includes:

a circular support base top;

a circular support base bottom;

a circular support base exterior side; and a circular support base interior side;

a circular catcher liner defining a liner interior secured within said circular support base interior side and extending beneath said circular support base bottom;

a plurality of fasteners disposed about said circular support base interior side for removably securing said circular catcher liner to said circular support base interior side;

a plurality of lifting fixtures disposed upon said support base top, said lifting fixtures are a plurality of hooks or a plurality of eye bolts, said lifting fixtures allow said debris catching device to be placed over and removed from a circular manhole;

wherein said circular support base is mounted over an open top of said circular manhole;

wherein said circular catcher liner is suspended within said circular manhole;

wherein said circular catcher liner is retaining debris therein;

wherein said circular support base includes an interior cavity;

wherein said circular support base includes a filling port in environmental communication with said interior cavity;

wherein said circular support base is made of a rigid materials;

wherein said support base is made of a acrylonitrile butadiene styrene plastic; and wherein said circular catcher liner is made of a fine-mesh nylon fabric sheet.

* * * * *